US007344105B2

(12) United States Patent
Lindsey

(10) Patent No.: US 7,344,105 B2
(45) Date of Patent: Mar. 18, 2008

(54) METHOD OF CONTROLLING THE WINDING OF A ROLL OF WEB MATERIAL

(75) Inventor: Bryan J. Lindsey, Tunkhannock, PA (US)

(73) Assignee: The Procter & Gamble Company, Cincinnati, OH (US)

( * ) Notice: Subject to any disclaimer, the term of this patent is extended or adjusted under 35 U.S.C. 154(b) by 498 days.

(21) Appl. No.: 10/860,299

(22) Filed: Jun. 3, 2004

(65) Prior Publication Data

US 2005/0273193 A1 Dec. 8, 2005

(51) Int. Cl.
*B65H 18/08* (2006.01)

(52) U.S. Cl. ..... 242/534; 242/541.4; 242/542.2

(58) Field of Classification Search ..... 242/547, 242/534, 542, 542.2–542.4, 541.4–541.6
See application file for complete search history.

(56) References Cited

U.S. PATENT DOCUMENTS

| | | | | |
|---|---|---|---|---|
| 3,871,598 | A | 3/1975 | Kataoka et al. | |
| 4,698,745 | A | 10/1987 | Hiroi et al. | |
| 4,768,143 | A | 8/1988 | Lane et al. | |
| 4,883,233 | A * | 11/1989 | Saukkonen et al. | 242/534.2 |
| 4,922,412 | A | 5/1990 | Lane et al. | |
| 5,311,435 | A | 5/1994 | Yocum et al. | |
| 5,548,192 | A | 8/1996 | Hanks et al. | |
| 5,611,500 | A | 3/1997 | Smith | |
| 5,673,870 | A | 10/1997 | Fielding et al. | |
| 5,690,298 | A * | 11/1997 | Ruck | 242/542.3 |
| 5,720,266 | A | 2/1998 | Nogl et al. | |
| 5,748,467 | A | 5/1998 | Qin et al. | |
| 6,036,137 | A * | 3/2000 | Myren | 242/541.7 |
| 6,128,541 | A | 10/2000 | Junk | |
| 6,424,906 | B1 | 7/2002 | Zhu et al. | |
| 6,487,459 | B1 | 11/2002 | Martin et al. | |
| 6,622,958 | B1 * | 9/2003 | Luomi et al. | 242/541.1 |
| 6,679,565 | B2 | 1/2004 | Riddiford | |
| 6,718,243 | B1 | 4/2004 | Yao et al. | |
| 6,752,347 | B2 * | 6/2004 | Lannes et al. | 242/534 |
| 2002/0033431 | A1 | 3/2002 | Leskinen | |
| 2005/0156078 | A1 * | 7/2005 | Ragard et al. | 242/534 |

FOREIGN PATENT DOCUMENTS

| | | |
|---|---|---|
| GB | 2 034 247 | 6/1980 |

(Continued)

*Primary Examiner*—Peter M. Cuomo
*Assistant Examiner*—Sang Kim
(74) *Attorney, Agent, or Firm*—Peter D. Meyer; David K. Mattheis; Betty J. Zea

(57) ABSTRACT

A method controls the response rate and profile of a variable parameter. The method determines an error value for a first variable parameter as the difference between a first parameter set point and a first parameter analog value. An output, controlled by a first variable-process-parameter control loop, adjusts according to the determined error value to adjust the parameter analog value and thereby reduce the error value at a response rate. The first variable-process-parameter control loop has a gain. The gain of the first variable-process-parameter control loop determines the response rate and the response profile. The analog value of a second variable parameter determines the gain. Adjusting the response rate of the control loop may provide a means of adjusting an error correction response profile of the first variable parameter.

19 Claims, 3 Drawing Sheets

FOREIGN PATENT DOCUMENTS

| | | |
|---|---|---|
| JP | 59 007650 | 1/1984 |
| JP | 64 048754 | 2/1989 |
| JP | 09 010670 | 1/1997 |
| JP | 2000 260028 | 9/2000 |

* cited by examiner

METHOD OF CONTROLLING THE WINDING OF A ROLL OF WEB MATERIAL

FIELD OF THE INVENTION

The present invention relates to controlling the error correction response profile of a first variable parameter according to a value analogous to a second variable parameter in a controlled process. More specifically the invention relates to the control of the error correction response profile of loading forces present during the winding of rolls of web materials according to the changing radius of the wound roll.

BACKGROUND OF THE INVENTION

Feedback based process control programs are well known in the art. These programs may monitor the values of variable parameters and compare these values to variable parameter set points to determine error values associated with each variable parameter. The program may then adjust one or more output values seeking to change the value of the variable parameter and to reduce the error value toward zero.

Plotting the values of a variable parameter and the set point for the parameter over time illustrates the error correction response profile for the variable parameter. The rate and manner at which the control program reduces the error value of the variable parameter may influence the response profile. The program may change the rate of error correction by adjusting either the rate of integration or the amount of proportional correction or both.

The physical realities of the controlled process may make particular characteristics of a response profile more or less desirable. The degree to which any particular characteristic is desirable may change over time and may depend upon other aspects of the controlled process. A method to provide flexibility in the characteristics of the error correction response profile is therefore desirable.

Those of skill in the art know that the use of gain scheduling may provide increased flexibility in control programs. Control programs may use gain scheduling to alter the relationship between a second variable parameter and the set point for the first variable parameter depending upon the value of a third variable parameter.

Control programs may use the magnitude of the error value associated with a first variable parameter to schedule the gain that determines the rate of correction of the error value of the first variable parameter.

Using gain scheduling to adjust the relationship between a first variable and the set point for a second variable, or for adjusting the rate of error correction associated with a first variable based upon the magnitude of the error associated with the first variable may not provide sufficient flexibility in achieving the rate of response and the desired response profile characteristics in all circumstances.

The winding of web materials may benefit from flexibility in the rate of response and response profile characteristics. Web materials constitute a common element of daily life. Metal films, non woven substrates, and paper products exemplify these web materials. The commercial production of these and other web materials may require the winding of the web material around a spool into a roll. The web material of the wound roll may subsequently be otherwise processed. The uniformity of the winding of a roll may affect the ability to successfully process the material of a roll, and the quality of any subsequent product produced from the material of the roll. Processing rolls wound in a non-uniform manner may not be possible or these rolls may yield products of unsatisfactorily low quality.

In the winding process, the web material may pass through a nip point formed between the roll being wound and a support structure of the web such as a winding reel. The nip pressure of the winding process may affect the quality of the winding of a roll. The nip pressure refers to the force applied to the web as the web passes through the nip point. An excessive nip pressure may break or damage the web. An insufficient nip pressure may result in a wrinkled or folded web, or a loosely wound roll. A non-uniform nip pressure over the winding of the roll may yield a non-uniform roll.

A feedback control loop may control the magnitude of the nip pressure. Portions of the winding process may benefit from adjustable error correction response profiles. Rolls of material wound by the process may benefit from adjusting the nip pressure error correction response profile during the winding process.

SUMMARY OF THE INVENTION

In one aspect, the method of the present invention controls the error correction response profile of a first variable parameter according to a value analogous to a second variable parameter. In this aspect, the method comprises steps of determining a set point and an analog value for a first variable parameter. The method then determines an error value for the first variable parameter according to the first variable parameter set point and the first variable parameter analog value. A first variable parameter control loop, acting at a first rate of response, may control the first variable parameter according to the error value. The method may further comprise steps of determining an analog value for a second variable parameter and adjusting the first rate of response according to the determined analog value of the second variable parameter. The use of the method may enable the control of the characteristics of the response profile of the first variable parameter.

In another aspect, the method of the present invention may control an apparatus for winding a web material into a roll about a spool. In this aspect, the method may reduce variations in the nip loading pressure and the deleterious affects these variations may have on wound rolls of the web material. According to the method of this aspect of the invention, a source provides a desired nip load pressure to a control program. The control program may also receive the weights of the spool and a primary carriage used to support the spool. The control program may then determine a set point for a first-side force according to the desired nip load and the provided weights. A first-side primary engaging element may apply an actual first-side force to the primary carriage and spool to support the spool. A winding reel may support and provide a routing path for the web material. The spool may rotate. As the spool rotates, the spool may form a nip with the winding reel. The web material may pass between the spool and the reel in the nip.

A portion of the web material may adhere to the spool and the web material may wind about the spool. A first sensor may determine a value analogous to the first-side force and provide this value to the control program. The control program may determine a first-side force error value according to the first-side force set point and the first-side force analog value.

A second sensor may determine a radius of the wound roll of web material. The control program may comprise a control loop, having a gain, for controlling the first-side force. The control program may determine the first-side force-control-loop gain according to the determined radius of the wound roll. The first-side force control loop may adjust the first-side force via a controlled output to reduce the first-side force error value toward zero. The first side force control loop may act to adjust the first side force at a response rate. The first-side force-control-loop gain may determine the response rate.

BRIEF DESCRIPTION OF THE DRAWINGS

While the claims hereof particularly point out and distinctly claim the subject matter of the present invention, it is believed the invention will be better understood in view of the following detailed description of the invention taken in conjunction with the accompanying drawings in which reference numbers identically designate corresponding features and in which:

DETAILED DESCRIPTION OF THE INVENTION

Figure 1:
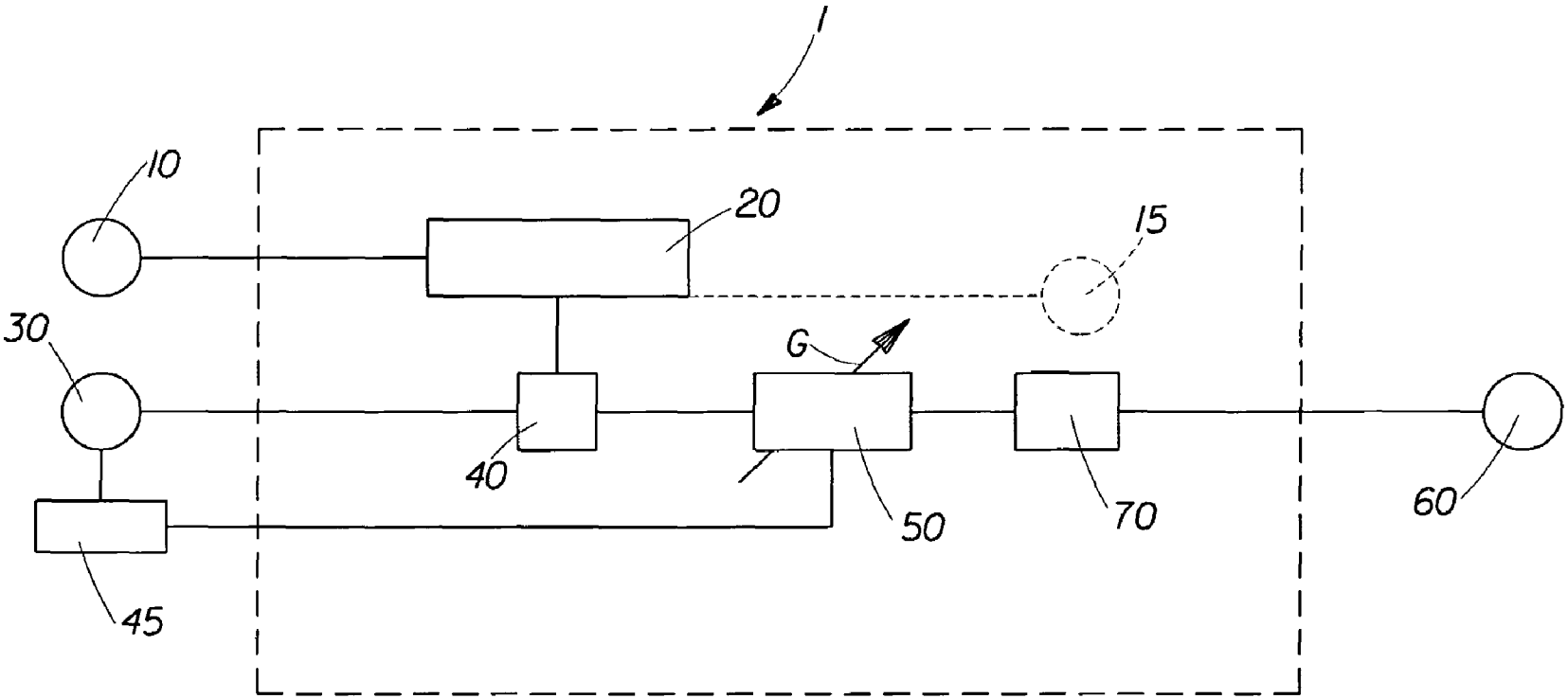
FIG. 1 shows a schematic representation of a control program according to one embodiment of the invention.

FIG. 1 illustrates the use of the method of the invention in a process control program 1. In one embodiment, a first source 10 provides a desired value for a first variable parameter to the control program 1. In an alternative embodiment a preprogrammed source 15 provides the desired value. The control program 1 may use the desired value to determine a set point for the first variable parameter in block 20. The control program 1 may make the set point equal to the desired value or may make the set point equal to a function of the desired value. The function of the desired value may include other variables provided to the control program 1. A second source 30 may provide an input to the control program 1 analogous to the value of the first variable parameter. The second source 30 may comprise any means appropriate for determining a value analogous to the first variable parameter. The control program 1 may determine a first variable parameter error value according to the set point and the analog value in block 40. A control loop 50 may then adjust an output controlling the analog value provided by source 30 of the first variable parameter to reduce the error value determined at block 40 toward zero. The output may alter the process at block 45 and may change the value of the input from source 30.

The control loop 50 and particularly the overall gain G of the control loop 50 may determine a rate of response of the adjustment of the output to reduce the error value toward zero. The control loop 50 may have a single gain or a plurality of gains which interact as an overall gain G to determine the rate of response. Exemplary control loop gains include proportional, integral, differential, and auxiliary gains.

The rate of response may affect the response profile of the first variable parameter. Response profile characteristics may include overshoot, wherein the value of the first variable parameter transitions from less than the set point to greater than the set point, undershoot, wherein the value of the first variable parameter transitions from greater than the set point to less than the set point, and a smooth response, wherein the value of the first variable parameter approaches and achieves the set point value without overshoot or undershoot. Adjusting the rate of response of the control loop 50 may provide flexibility in the characteristics of the response profile as the error value approaches zero. Changing the gain or gains G of the control loop 50 may facilitate the control of the response profile with regard to the occurrence and magnitude of any overshoot and/or undershoot of the first variable parameter.

A gain determining function 70 may provide the control loop 50 with varying gain G values. A value analogous to a second variable parameter may determine the variation in the provided gain G values. According to the method of the invention, a third source 60 determines a value analogous to a second variable parameter and provides this value to the gain determining function 70. The third source 60 may comprise any means known to those of skill in the art for determining a value analogous to the second variable parameter.

The gain determining function 70 may then determine a value for one or more control loop gains G according to the second variable parameter analog value. In one embodiment the gain determining function 70 may determine the control loop gain or gains G according to a programmed function using the analog value of the second variable parameter. In another embodiment the gain determining function 70 may select control loop gain G values from a schedule of gain values distinguished according to predetermined values of the second variable parameter analog value.

The control program 1 may change the gain or gains G of the control loop 50 as or after the second variable parameter analog value changes. Changing the gain or gains G may change the rate of response of the control loop 50 in reducing the error value of the first variable parameter and/or a response profile of the first variable parameter.

Figure 2:
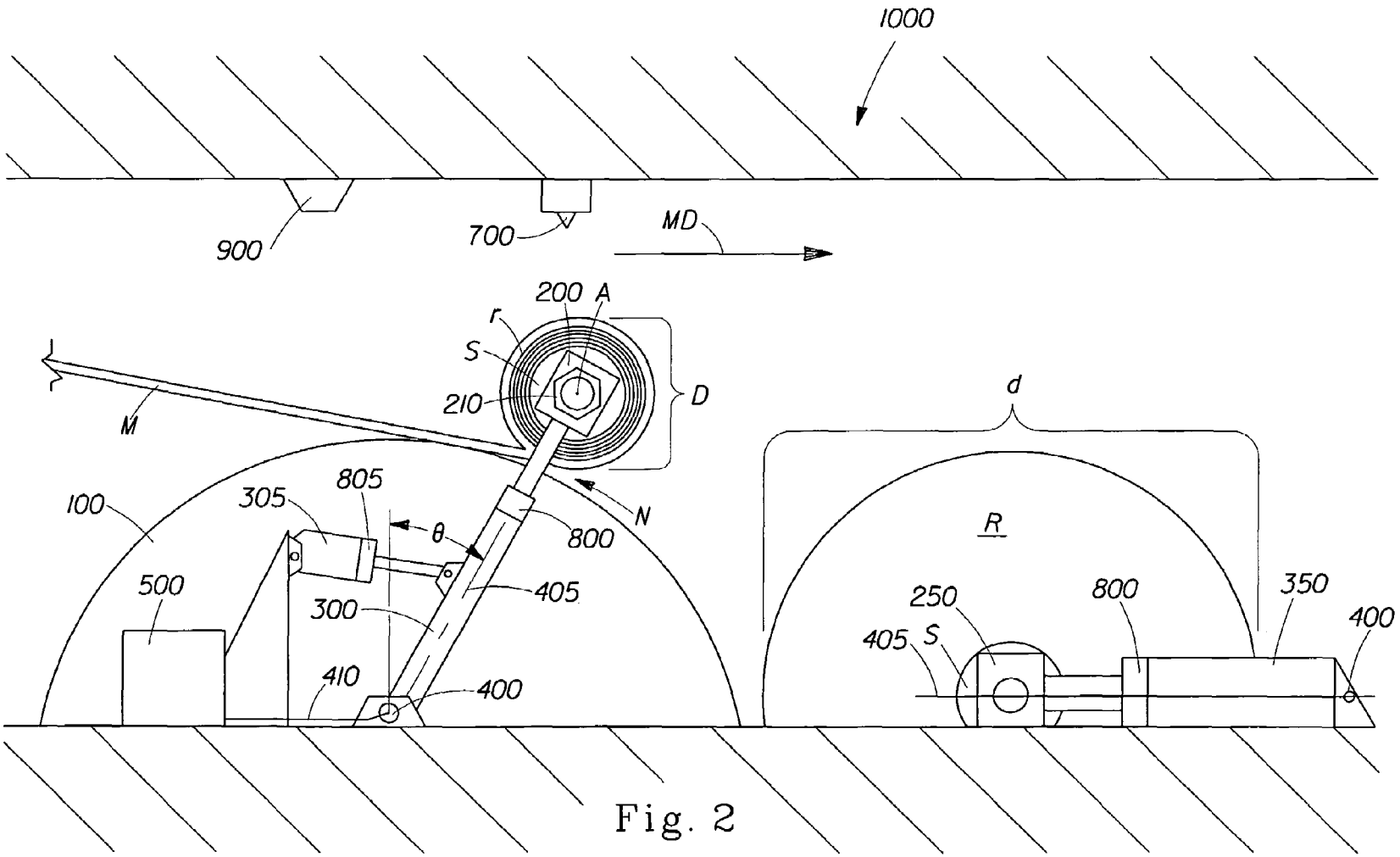
FIG. 2 shows a schematic side view of a winding apparatus controlled according to one embodiment of the method of the invention.
Figure 3:
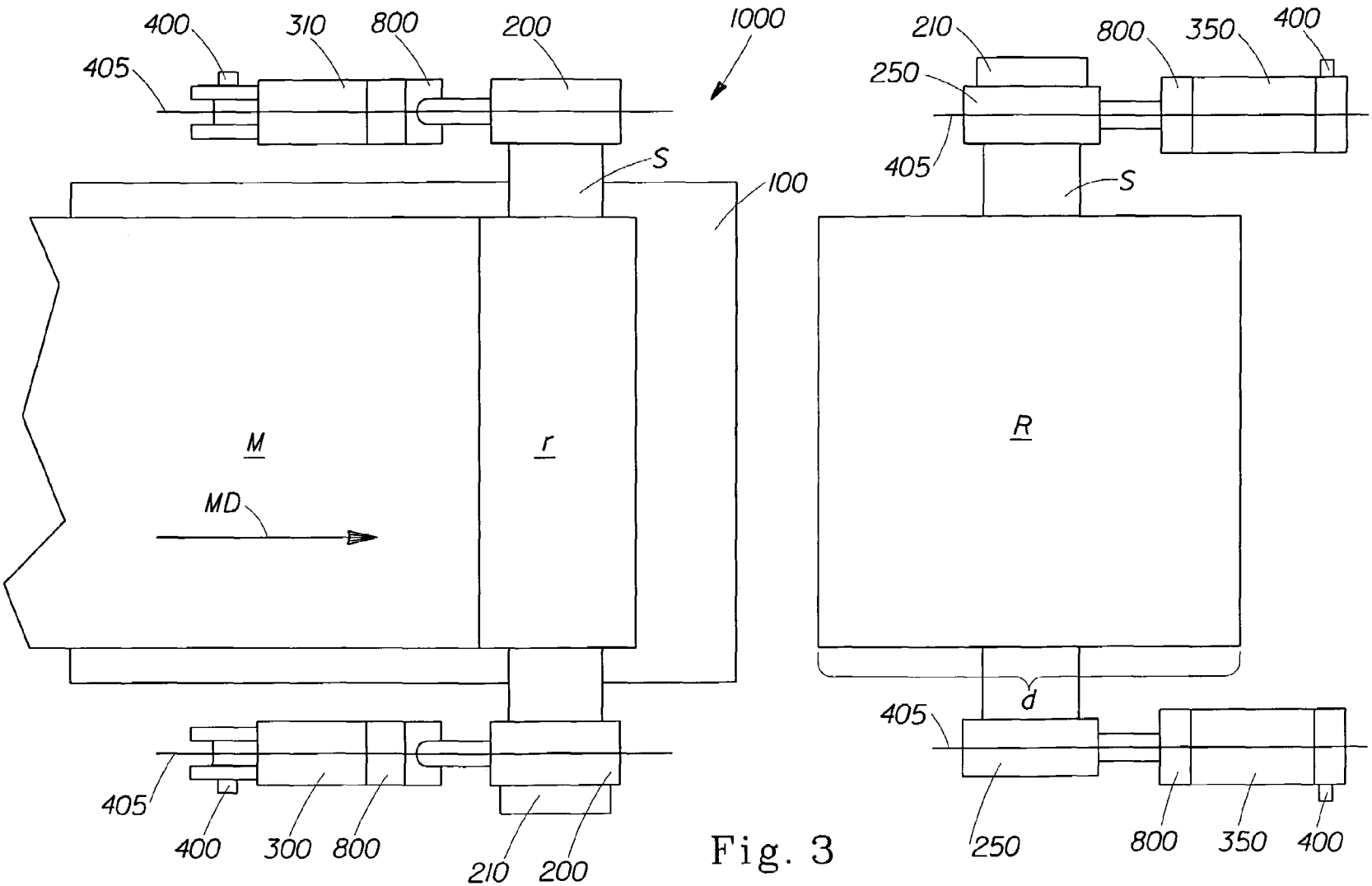
FIG. 3 shows a plan view of an apparatus controlled according to another embodiment of the invention.

FIGS. 2 and 3 show examples of winding apparatus 1000 that may be controlled according to the method of the invention. The method of the invention may be applied to the control of any process variable and is not limited to the control of a winding apparatus 1000. The apparatus 1000 may wind a web material M about a spool S. The web material M may comprise any known web material. Exemplary web materials include, without being limiting, paper webs including printing papers as well as tissue and paper toweling, woven and non-woven textiles, polymeric films, and metal foils.

A control program may carry out the steps of the method. The control program may reside within a process controller 500, one or more auxiliary controllers (not shown), or combinations thereof.

The process controller 500 may comprise any control unit capable of controlling the winding apparatus 1000. The process controller 500 may receive input signals from a variety of sensors and may provide output signals to a variety of end effectors. A control program of the process controller 500 may relate the input signals to the output signals. As a non limiting example, the process controller 500 may receive inputs from load cells, position sensors, pressure and flow transducers, and other sensors known to those of skill in the art, and may provide output signals to control valves, servo controllers, motor starters, variable speed drive controllers and other output devices known to those of skill in the art. A CONTROLLOGIX 5555 1756-L55 controller from Rockwell Automation, of Milwaukee Wis., exemplifies a suitable process controller 500.

The winding apparatus 1000 of FIGS. 2 and 3 may be described as having a machine direction MD along the general path of the web material M moving through the apparatus 1000, a first side and an opposing second side each substantially parallel to the machine direction MD. Elements disposed on the first side of the apparatus 1000 are considered first-side elements. Similarly, elements disposed upon the second side of the apparatus 1000 are considered second-side elements.

According to FIG. 2, Reel 100 supports and provides a routing path for web material M as the web material M proceeds through the apparatus 1000. Primary carriage 200 may engage and support spool S. The primary carriage 200 may apply a torque to the spool S to rotate the spool S about a winding axis A of the spool S via a spool assist drive 210. The spool assist drive 210 may engage one end of the spool S and apply a torque to the spool S. Alternatively the primary carriage 200 may support the spool S as an external means, such as a bump drive (not shown) contacts and rotates the spool S. The surface speed of the outer circumferential surface of the rotating spool S may substantially match the speed of the surface of the reel 100 and the web material M. Alternatively, the surface speed of the spool S may vary from the surface speed of the reel 100 to draw or crepe the web material M.

A first-side primary engaging element 300 may support the primary carriage 200 and spool S. The first-side primary engaging element 300 may apply a force to support the primary carriage 200/spool S combination. The first-side primary engaging element 300 may also control the position of the spool S relative to the reel 100, and/or regulate the force of the spool S against the reel 100.

The first-side primary engaging element 300 may engage and support the spool S in a cantilever arrangement wherein the first-side primary engaging element 300 supports the spool S, the primary carriage 200, and any spool assist drive 210 from one side of the apparatus 1000. In an another embodiment illustrated in FIG. 3, the first-side primary engaging element 300 may support the primary carriage 200/spool S combination as one of a pair of primary engaging elements 300, 310. In another embodiment (not shown) the first-side primary engaging element 300 may support a primary carriage 200 as a yoke comprising a pair of support arms extending from the first-side primary engaging element 300 to each end of the spool S.

The first-side primary engaging element 300 may comprise any means known in the art for applying a regulated force and enabling motion. Exemplary first-side primary engaging elements 300 include, without being limiting, hydraulic cylinders, pneumatic cylinders, linear servo motors, linear actuators, combinations thereof, and other means known in the art.

The first-side primary engaging element 300 may move the primary carriage 200/spool S combination to a position eliminating any gap between the spool S and the reel 100 thereby forming a nip N. The web material M may pass through the nip N between the spool S and the reel 100. Passage through the nip N may apply a force to the web material M. The magnitude of the applied force (nip force) generally has units of force per unit length. The nip force may equal the total force applied across the width of the nip N divided by the nip width. Exemplary units for the nip force include pounds per lineal inch (pli), and Newtons per linear meter (Nlm).

In one embodiment, an operator may provide a desired nip force $F_{nip}$ to the control program of the process controller 500. The operator may provide the desired nip pressure $F_{nip}$, to the control program via a human-machine interface, or HMI (not shown). The HMI may comprise any control center known to those of skill in the art. The HMI may enable the operator to view information regarding the controlled process, to provide inputs to the process controller 500, and to actively interact with the control program in the operation of the winding apparatus 1000. A RAC 6200 industrial touchscreen computer available from Rockwell Automation of Milwaukee, Wis., using Metso DNA software from Metso Automation of Atlanta, Ga., exemplifies a suitable HMI.

The desired nip force $F_{nip}$ may vary depending upon the type of web material M being wound and the desired characteristics of the wound roll r, R. As an example, a higher nip force may yield a more tightly wound roll r, R of material. Too high a nip force may destroy the integrity of the web material M and adversely affect the productivity of the winding operation by causing the process to stop. Too low a nip force may yield a roll r, R too loosely wound or a roll r, R having a wrinkled or folded web material M.

Ideally, the nip force yields a uniformly wound roll r, R of web material M without compromising the quality of the web material M. In one embodiment, a nip force of about 100 pli (17.6 kNm) may represent a desired nip force $F_{nip}$. In another embodiment, for winding a less resilient web material, about 10 pli (1760 Nm) may represent the desired nip force $F_{nip}$. In yet another embodiment, for winding a web material while minimizing any affect of the nip N on the web material M, about 0.1 pli (17.6 Nm) may represent the desired nip force $F_{nip}$.

A weight W (not shown) of the load supported by the first-side primary engaging element 300 may be provided to the control program. The weight W may include a weight of the primary carriage 200, the spool assist drive 210 and the spool S as preprogrammed constant values. Alternatively, sensor 400 may actively determine the weight W and may provide the determined weight W as an input to the control program. Actively determining the weight W may yield a more accurate value for the weight W since the active determination may take into consideration system wear, variations in system performance and variations in spools.

Sensor 400, configured in the mounting of a first-side primary engaging element 300, may determine an analog value for the force acting upon the first-side primary engaging element 300, hereinafter referred to as the first-side force. The sensor 400 may determine a force acting along the sensing axis 405 of the sensor 400. When the spool S is not pressing against the reel 100 this force is the weight W of the load supported by the first-side primary engaging element 300 and may include the weight of the primary carriage 200, the spool assist drive element 210, the spool S and combinations thereof. When the spool S is pressing against the reel 100 the force may further include the force on the first-side primary engaging element 300 due to the pressing of the spool S against the reel 100. Forces acting in directions not aligned with the sensing axis 405 may not be sensed.

The sensing axis 405 of the sensor 400 may align with an axis extending from the mounting of the first-side primary engaging element 300 to a winding axis A of the spool S. In an alternative embodiment, the configuration of the sensor 400 may orient the sensing axis 405 vertically. In still another embodiment the forces may be determined using a plurality of sensors 400. In this embodiment aligning the sensing axis 405 of each of the respective sensors 400 in a distinct direction may enable the determination of the forces acting upon the first-side primary engaging element 300 in a plurality of directions. As an example a first sensor 400 may determine forces acting vertically and a second sensor 400 may determine forces acting horizontally upon the first-side primary engaging element 300. A KISD-6 load cell available from Vishay Nobel A.B. of Karlskoga, Sweden, exemplifies a suitable sensor 400.

A communication link 410 may provide the output of the sensor 400 to the process controller 500 as an input in the winding control program. The communication link 410 may comprise any communication means known to those of skill in the art. Exemplary communication means include, without being limiting, direct wiring from the sensor 400 to the input circuits of the process controller 500, a multiplexed communication link between the sensor 400 and the process controller 500, a wireless communication link between the sensor 400 and the process controller 500, and combinations thereof.

The force component due to the weight W may vary depending upon the angle θ at which the first-side primary engaging element 300 supports the primary carriage 200/spool S combination. This angle θ may range between zero degrees to more than ninety degrees from vertical. The component of the weight W acting upon the first-side primary engaging element 300 along a line between the first-side primary engaging element 300 mounting and the winding axis A of the spool S may vary according to the cosine of the angle θ.

The first-side primary engaging element 300 may further comprise a means of traversing the primary carriage 200 and the spool S from a first position wherein the winding axis A of the spool S lies substantially parallel to the axis of the reel 100 and substantially in a vertical plane passing through the axis of the reel 100, to a second position wherein the winding axis A of the spool S lies substantially parallel to the axis of the reel 100 and substantially in a plane at a predetermined angle θ from vertical.

The angle θ may vary via the motion of one end of a first-side primary traversing element 305 supporting the first-side primary engaging element 300. A linear position sensor 805 may provide the position of the moving end of the first-side primary traversing element 305. The control program may determine the angle θ according to the position of the moving end of the first-side primary traversing element 305. A Parker 2HX hydraulic cylinder with an LDT transducer, available from Parker Hannifin Corporation, Des Plaines, Ill. exemplifies a suitable first-side primary traversing element 305.

The control program may use the provided desired nip pressure $F_{nip}$ and weight W to determine a set point for the first-side force. The following equation may relate the first-side force set point and the desired nip pressure:

$$F_{nip}=W\cos\theta-F_t,$$

where: $F_{nip}$ represents the desired nip pressure,

W represents the weight of the primary carriage 200/spool S combination cos θ represents the cosine of the angle from vertical at which the first-side primary engaging element 300 supports the primary carriage 200/spool S combination, and $F_t$ represents the set point for the first-side force.

In one embodiment, the control program presumes that the value of W remains constant as the web material M initially builds upon a roll r. The relative weights of the primary carriage 200/spool S combination and the initial amount of web material M form the underlying basis of this assumption. In an alternative embodiment, the control program may adjust the value of W as the web material M initially builds upon the roll r. In this embodiment, the density of the web material M and the volume of web material M, as determined by a feed rate or the increase in diameter of the roll r, may determine the incremental increase in the value of W as the roll r builds.

The equation may vary depending upon the specific geometry of the support of the primary carriage 200/spool S combination, the nature and/or orientation of the sensor or sensors 400, and the specifics of the travel path of the spool S around the circumference of the reel 100. The fundamental nature of the equation will remain a relationship between the desired nip pressure $F_{nip}$ and the weight W of the supported load in combination with the force acting upon the first-side primary engaging element 300.

As or after the first-side primary engaging element 300 moves the spool S into contact with the web material M forming a nip N with the reel 100, an adhering means may cause a portion of the web material M to adhere to the spool S. The adhering means may comprise any means known in the art. A liquid adhesive applied by a reciprocating glue applicator 700 illustrates an exemplary means of adhering the web material M to the spool S.

As or after the web material M adheres to the spool S, means known to those of skill in the art separate the portion of the web material M adhered to the spool from the downstream web material M at a point between the spool S and a preceding roll R. The web material M begins to wind around the spool S forming roll r. As the web material M winds around the spool S the diameter D of the roll r increases. As the diameter D of the roll r builds, the first-side force analog value may decrease as additional layers of web material M pass through the nip N. The first-side force error value may increase causing the control program to alter the first-side primary engaging element 300 output to adjust the applied first-side force and therefore reduce the first-side force error value. This change in the output may move the spool S away from the reel 100 to accommodate the additional web material M building upon the roll r and therefore reduce the first-side force error value.

A linear position sensor 800 coupled to the primary carriage 200, or the first-side primary engaging element 300 may provide the process controller 500 with an input relating to the position of the winding axis A of the spool S relative to the reel 100, as well as the position of the primary carriage 200 relative to the mounting of the first-side primary engaging element 300. An operator may provide the diameter of the spool S via the HMI, or additional sensors (not shown) may provide the spool S diameter. The control program may use these inputs to determine changes in the position of the spool S. The control program may use the changes in the position of the spool S as the roll r builds to determine the diameter D of the roll r. Similarly, changes in the position of the secondary carriage may be used to determine the diameter d of the roll R.

The spool S may move to a position very near the reel 100 prior to the formation of the nip N according to the determined position of the spool S. An operator may provide a position set point to the control program that is used to position the spool S very near the reel 100. The control of the spool S may then change from position based to force based. The control program may then adjust the position of the spool S according to the first-side force control set point to close the remaining distance between the spool S and the reel 100.

In one embodiment, the web material M may comprise a low density, high bulk tissue paper. This web material M may benefit from a force error correcting rate of response that varies over the course of winding rolls of the web material M. As an example, the reel 100 and the spool S may have relatively hard surfaces. The spool S may also have an irregular surface due to residual adhesive or web material M. The impact of the spool S with the reel 100 supported web material M may yield large values for the first-side force error. In an embodiment having a rapid rate of response of the first-side force control loop, the system may attempt to quickly correct the initially large error values resulting in an undesirable unstable first-side force control loop. Reducing the rate of response of the first-side force control loop may provide more reliable performance.

As the web material M builds on the spool S, the dynamics of the nip N may change. The nip pressure may build as the diameter D of the roll r increases until the spool S moves further from the reel 100. The nature of the web material M may require that the first-side force control loop respond rapidly to small changes in the first-side force error value to prevent the nip pressure from increasing to a load in excess of the tensile properties of the web material M. Such an increase in the load may result in a web breakage due to the excessive force.

As the diameter D of the roll r continues to build, the high-bulk, low-density nature of the web material M may provide a cushion capable of absorbing a greater range of nip pressure increase without adversely affecting the roll r, or breaking the web material M. The rate of response of the first-side force control loop to changes in the first-side force error value may decrease as the capability of the wound web material M to serve as a dampening cushion increases. Decreasing the rate of response of the first-side force control loop may reduce the abruptness of changes in the output for first-side primary engaging element 300, and may yield a more uniformly wound roll r.

As shown in FIG. 2, the roll r may transfer from the primary carriage 200 and the first-side primary engaging element 300 to a secondary carriage 250 and a first-side secondary engaging element 350. The transfer from the primary carriage 200 to the secondary carriage 250 may require an adjustment in the rate of response. The program may adjust the rate of response as or before the transfer occurs. Adjusting the rate of response of the first-side force control loop may prevent abrupt changes in the output for the first-side primary engaging element 300, or the first-side secondary engaging element 350 as the transfer occurs.

In one embodiment, the program may alter the rate of response of the first-side force control loop by changing a proportional, integral, auxiliary, or derivative gain of the first-side force control loop, or any combination of these gains. The program may change the gain, or gains according to a gain schedule or according to a gain determination function.

In one embodiment, the control program may use the determined diameter D of the roll r in conjunction with a gain schedule to adjust the control loop gains and the rate of response of the first-side force control loop. In this embodiment, when the web material M of the roll r has a zero radius, and until a first predetermined threshold amount of web material M winds on the spool S, the gain schedule may provide first set of gains comprising a combination of gains which provide a first rate of response in the first-side force control loop. This first set of gains may provide a fast or slow rate of response depending upon the desired response profile for the associated portion of the winding process. In one embodiment, the first set of gains provides a slow rate of response yielding a response profile with no overshoot. The combination may include proportional, integral, derivative, and auxiliary gains and combinations thereof.

As or after the diameter D of the roll r reaches a first predetermined threshold value, the control program may change the proportional and/or integral gain of the control loop according to the gain schedule to provide a second rate of response. As or after the diameter D reaches subsequent threshold radius values, the program may make subsequent changes to the proportional and/or integral gains to increase or decrease the rate of response as desired.

In another embodiment, the control program may continuously determine the gain, or gains of the first-side force control loop according to a programmed gain determining function. In this embodiment, the gain determining function may use the determined diameter D as an input and determine new values for the desired gain, or gains as the determined diameter D value changes.

Gain scheduling and gain determining functions may be used singly or in combination with each other and also in combination with programmed time delays to provide additional flexibility in the timing of the changes to the control loop gains.

The respective gains in the first-side force control loop may function in any manner known to those of skill in the art. As an example, a proportional gain may adjust the proportion of the error subject to correction in a given processor scan interval. An integral gain may determine a rate of error elimination.

In the embodiment illustrated in FIG. 3, a second-side primary engaging element 310 supports an end of the spool S opposed to the first-side primary engaging element 300. The second-side primary engaging element 310 may support the spool S in a manner similar to that of the first-side primary engaging element 300. The second-side primary engaging element 310 may also support a primary carriage 200 and/or a spool drive assist 210 as described above. In this embodiment, the control program may assume that the desired nip pressure represents the combination of the weight W, the first-side force, and a second-side force. The equation provided above may determine the first-side force set point and the second-side force set point. The first-side force and the second-side force may combine to provide the desired nip force. In one embodiment the set point for each of the first and second side forces is determined to be half the desired nip force combined with the determined weight of the load supported by the respective first-side or second-side primary engaging element 300, 310.

In one embodiment, a method similar to that described above for determining the position of the first-side primary engaging element 300 may determine the position of the second-side primary engaging element 310. The control program may then use the position of the first-side primary engaging element 300 to determine a set point for the position of the second-side primary engaging element 310. The set point may be the actual position of the first side element or the actual first side position plus or minus an offset value. The control program may determine a second-side position error value as the difference between the second-side primary-engaging-element-position set point and the determined position of the second-side primary engaging element 310. The control program may then adjust the position of the second-side primary engaging element 310 to reduce the position error value.

A second sensor 400, similar to the first such sensor 400, may determine and provide a second-side force analog value in a manner similar to that described above for the first-side force analog value. The control program may then use the difference between the second-side force set point and the second-side force analog value to determine a second-side force error value.

In one embodiment, the control program may control the second-side force according to a second-side force control loop to reduce the second-side force error value in a manner similar to that described above for the first-side force. In this embodiment, the control program may adjust one or more gains of the second-side force control loop according to the diameter D of the roll r as described above.

In another embodiment, the control program may use the second-side force error value in conjunction with the second-side position control described above. In this embodiment an output of the control program controls the position of the second-side primary engaging element 310. The control program may adjust the second-side position set point according to the second-side force error value. As an example, a positive force error may indicate a second-side force analog value less than the second-side force set point. Adjusting the second-side position set point such that the output for the second-side primary engaging element 310 moves the second-side end of the spool S away from the reel 100 may raise the second-side force analog value and reduce the second-side force error value toward zero.

The initial threading of the web material M into the nip N may require an alteration of the first-side and/or second-side controls. The winding process may achieve the initial threading of the web material M by passing only a portion of the total width of the web material M through the nip N and incrementally increasing the width of web material M passing through the nip N until the total width of web material M passes through the nip N. Initially, web material M only builds upon a portion of the spool S.

As an example, the initial portion of the web material M may pass through the nip N on the first side of the spool S and may not extend completely across the width of the nip N. As this occurs, less than the full width of the web material M may bear the entire nip load potentially subjecting the web material M to excessive nip forces. The specific details of the winding process may make it desirable to provide a thread-up percentage reduction value and to adjust the first-side force set point according to the thread-up percentage reduction value. In this manner, the second side of the nip N may bear a greater proportion of the desired nip pressure. This may also reduce the likelihood of breaking the web material M building on the first side of the spool S due to excessive nip loading. In this embodiment, the first-side force set point may be reduced according to the thread-up percentage reduction value. The second-side force set point may remain unchanged.

In another embodiment, wherein the second-side primary engaging element 310 is controlled according to a set point based upon the position of the first-side primary engaging element 300 together with the second-side force error value, the second-side position set point may be adjusted to maintain a closed nip N on the second-side of the apparatus as the roll r builds on the first-side of the apparatus.

In one embodiment, the control program may alter the first and/or second side control logic for a predetermined amount of time. This amount of time may correspond to the time until of the full width of the web material M is passing through the nip N. In one embodiment, shown in FIG. 2, web detection sensor 900 may detect the presence of the full width of the web material M in the nip N and provide an input to the process controller 500 to cease the application of the thread-up percentage reduction. In another embodiment, the web detection sensor 900, used in conjunction with a time delay, may determine when to cease the application of the thread-up percentage change to the desired first-side force.

In another embodiment, the alterations to the control logic may include a predetermined progression for the position of the first-side primary engaging element 300. In this embodiment, the motion of the first-side primary engaging element 300 may proceed according to the predetermined progression to enable the build up of web material M on only the first side of the roll r. The control of the second-side primary engaging element 310 may proceed as a proportion of the first side position, according to a second predetermined progression, or under the control of a previously described second-side force control loop.

The predetermined progression may comprise a portion of the control program as a series or schedule of position set points, or as a position set point determining function. Either the position schedule or the position function may use time or the diameter D of the roll r as a trigger for altering the position set point.

In yet another embodiment, the control program may subtract a predetermined offset value from the position set point for the second-side primary engaging element 310. In this embodiment, the operator may provide a set point offset value via the HMI or other means. The control program may adjust the second-side position set point according to the offset value to maintain a closed nip N on the second side as the web material M builds on the first side.

Web break detection logic may control the implementation of the offset value's use. In one embodiment, illustrated in FIG. 2, the web detector 900 senses the absence of the web material M indicating a web break. As or after the web detector 900 again senses the web material M the control program may subtract the offset value from the second-side position set point. This subtraction may occur immediately or after a predetermined time delay. As or after, a second web detector (not shown) senses the web material M the control program may cease subtracting the offset value from the second-side position set point. Again this may occur immediately, or after a predetermined time delay. The control program may implement and/or cease the use of the offset value abruptly or gradually. In other words, the initial subtraction may use the full value of the offset value or may use a smaller value and progress in a predetermined manner to the subtraction of the full value. Similarly, the cessation of the use of the offset may occur by abruptly ceasing to subtract the full value of the offset value or may alternatively occur through the gradual reduction of the value subtracted in a predetermined manner.

At roll turnover, when an empty spool S is brought into contact with the reel 100 a new roll r begins to wind and the previous roll R ceases to wind, the web material M may also initially build on only one side of the roll r. As an example the web material M may adhere to the new spool S and separate between the completed roll R and the new roll r due to increased web tensile forces. Providing an adhesive to the spool S via a reciprocating adhesive applicator 700 that proceeds from the second side of the spool S toward the first side of the spool S may adhere the web material M to the new spool S. The web material M may separate and begin to wind on the new roll r from the second side toward the first side. The web material M may build more rapidly upon the second side of the roll r.

The control program may provide turnover compensating logic in the form of a predetermined progression for the position of the second-side primary engaging element 310 according to predicted, or empirically developed, data. The predetermined position progression on the second side of the spool S may occur independently of the control of the first side of the spool S, or the predetermined position progression may be overlaid in a control program wherein the second side position follows the first side position. In either embodiment, the control program may also use the second-side force error value to adjust the position of the second-side primary engaging element 310.

In another embodiment, the turnover compensating logic may add a predetermined offset value to the position set point for the second-side primary engaging element 310. In each of these two embodiments, the control program may initiate the use of the specific turnover compensating logic when turnover conditions are sensed. As an example, the control program may initiate the turnover logic as or after, the reciprocating adhesive applicator 700 begins to traverse the spool S and to apply adhesive. The control program may wait for a predetermined time delay prior to implementing the turnover logic. The control program may cease the use of the turnover logic as or after the reciprocating adhesive applicator 700 has fully traversed the spool S and/or ceased to apply adhesive. Again, the control program may wait a predetermined amount of time prior to ceasing the use of the logic. The turnover compensating logic may initiate and/or cease abruptly or gradually in a manner similar to that described above for the thread-up position offset value.

In any of the above described embodiments, the rates of response of the respective control loops may be adjusted according to a gain function or a gain schedule using the determined value of the radius of the web material M wound upon the spool S as a trigger for changes in the gain.

The above described linear position sensors, 800 and 805 together with web detection sensors 900 may communicate with the process controller 500 in the same manner described for sensor 400 via appropriate communication links (not shown).

EXAMPLE 1

In the dry end of a paper making machine, a reel supports and provides a routing path for the paper web. A machine operator provides a desired nip pressure and a spool diameter value to a process controller via a Human Machine Interface (HMI). The process controller stores these values in memory.

The paper web winds upon a first spool supported at each end by a secondary carriage and manipulated by a pair of secondary-engaging-element hydraulic cylinders. The spool has a first end and a second end. A pair of horizontal rails supports the first spool and secondary carriages. The secondary-engaging-element hydraulic cylinders, coupled to the secondary carriages, maintain the winding roll in contact with the reel and move the secondary carriages and the spool progressively further from the reel along the horizontal beam as the diameter of the roll builds. A first spool assist drive coupled to the first side end of the spool provides a torque to rotate the first spool.

Primary carriages support each end of a second spool. A second spool assist drive coupled to the primary carriage on the second side of the winding apparatus provides a torque that rotates the spool. Each primary carriage connects to one of a pair of primary-engaging-element hydraulic cylinders. These hydraulic cylinders have the capability of supporting the spool, the spool assist drive, and the primary carriages in a first position wherein all of the weight of the spool, the spool assist drive, and the primary carriages acts along the axis of the primary engaging element hydraulic cylinders.

Load cells integrated into the mountings of each of the primary-engaging-element hydraulic cylinders determine the axial load upon each of the cylinders. The load cells communicate these loads to the process controller. The process controller stores the inputs from the load cells, representing the downward force of the spool supported in the first position, as the weight of the spool/primary carriage combination. A control program determines a force set point for each of the first and second side primary-engaging-element hydraulic cylinders. The control program uses the combination of the determined weight and the provided desired nip force to determine the force set points. The provided weight may vary from the first side to the second side and the set points may reflect this variation. The control program divides the desired nip force equally among the first and second side set points.

Linear position sensors, integrated into each of the primary-engaging-element, and secondary-engaging-element hydraulic cylinders, provide cylinder position inputs to the process controller according to the position of the moving end of each cylinder. The secondary-engaging-element hydraulic cylinders maintain the first spool in an orientation generally parallel to the reel. The control program uses the positions of the primary-engaging-element, and secondary-engaging-element hydraulic cylinders in conjunction with the provided spool diameter to determine the distance between the outer surface of each spool and the outer surface of the reel. The primary-engaging-element hydraulic cylinders alter the position of the second spool to reduce the gap between the spool and the reel.

A pair of primary rotation hydraulic cylinders traverses the position of the second spool around the circumference of the reel from the first position with the axes of the primary engaging element hydraulic cylinders oriented vertically, to a second position with these axes oriented about thirty degrees from vertical. A linear position sensor provides an input to the process controller indicating the position of the primary rotation hydraulic cylinder on the first side of the winding apparatus. The control program uses this position to determine the angle from vertical of the primary engaging element hydraulic cylinders.

For the secondary-engaging-element hydraulic cylinders, the load cells provide the force acting upon the axis of each cylinder. The comparison of this force with the respective force set points for each cylinder determines a force error for each of the second-side and first-side cylinder. The control program may adjust an output that alters the force applied to the first-side secondary-engaging element hydraulic cylinder to reduce the first-side force-error value toward zero. As an example: for a positive first-side force-error value the force applied to the first-side secondary-engaging-element hydraulic cylinder increases to reduce the first-side force-error value toward zero.

The position of the second-side secondary-engaging-element cylinder adjusts according to the position of the first side cylinder. For example: as the first-side secondary-engaging-element hydraulic cylinder moves further away from the reel, the control program adjusts the second-side secondary-engaging-element hydraulic cylinder position to follow the position of the first-side secondary-engaging-element hydraulic cylinder.

As the diameter of the first spool nears a final roll diameter, a reciprocating adhesive applicator applies adhesive to the second spool and the primary engaging elements move the second spool into contact with the web material forming a nip with the reel. A web separator separates the web material between the second spool and the first spool.

Load cells provide the forces acting along the axis of each of the pair of primary-engaging-element hydraulic cylinders. These forces represent the combination of the weight of the second spool and the primary carriages, together with the force between the spool and the reel. The control program determines a force set point for each of the pair of primary-engaging-element hydraulic cylinders using the determined weight of the spool/primary carriage combination and the desired nip force. These set points are adjusted by the control program as the support angle of the primary-engaging-element hydraulic cylinders changes. The proportion of the weight acting upon the axis of each cylinder varies as the cosine of the angle from vertical of the cylinder axis varies.

A comparison between the load cell input and the force set point for each of the first and second sides of the spool determines respective first and second side force error values. The control program adjusts the output for the first-side force to reduce the first side force error value to zero. The position of the second side cylinder adjusts according to the position of the first side cylinder. For example: as the first side cylinder moves further away from the reel, the second side cylinder position adjusts to follow the first side cylinder. The control program uses inputs from the primary engaging element linear position sensors and the provided spool diameter to determine the diameter of the roll.

The first side force error for each of the first-side primary-engaging-element hydraulic cylinders adjusts via an output determined according to a first-side force control loop program in the process controller. Control loop proportional and integral gains determine the rate at which the force error value reduces toward zero. The proportional gain determines a percentage output change in proportion to the error value. The integral gain determines the rate of output change according to the accumulated error value.

The proportional and integral gains may change according to a predetermined gain schedule based upon the determined diameter of the roll. The combination of the selected proportional and integral gains yields an overall rate of response. The initial combination may be selected to provide a slow rate of response. As the diameter builds, the proportional gain may increase to increase the rate of response. As the diameter continues to build, the integral gain may be selected to provide a lower rate of correction and a slower rate of response to changes in the force error.

The provided spool diameter and the position of the first-side cylinder determine the diameter of the roll. As the roll builds on the second spool, the spool traverses along the perimeter of the reel from the initial nip position to a building position where the spool transfers from the primary carriages to the secondary carriages. To reduce the likelihood of transfer related issues, the determined force error value of the second side enhances the control of the position of the second side hydraulic cylinders.

After the primary carriages and the supporting hydraulic cylinders have traversed through at least eighty degrees from vertical, the process controller uses the second side force error value to adjust the position set point for the second side hydraulic cylinders. The process controller modifies the position set point to reduce the second side force error to zero. Maintaining the position difference between the first side and second side of the spool at no greater than 1 inch (2.54 cm) constrains the modification of the position set point.

All documents cited in the Detailed Description of the Invention are, in relevant part, incorporated herein by reference, the citation of any document is not to be considered as an admission that it is prior art with respect to the present invention.

While particular embodiments of the present invention have been illustrated and described, it would have been obvious to those skilled in the art that various other changes and modifications can be made without departing from the spirit and scope of the invention. It is therefore intended to cover in the appended claims all such changes and modifications that are within the scope of the invention.

What is claimed is:

1. A method of controlling the winding of a web material about a spool, the method comprising steps of:

a) providing a web material, b) providing a spool about which the web material may be wound, c) providing a desired nip load, d) determining a first-side force set point according to at least the desired nip load, e) applying a first-side force to the spool with a first-side primary engaging element, f) supporting the web material with a rotating reel, g) forming a nip between the spool and the reel, h) passing the web material through the nip, i) winding the web material around the spool forming a wound roll, j) determining a first-side force analog value, k) determining a first-side force error value according to the first-side force analog value and the first-side force set point, l) determining a radius of the wound roll, m) determining a first-side force-control-loop gain according to the radius of the wound roll, and n) adjusting the first-side force to reduce the first-side force error value according to the first-side force control loop at a response rate, wherein the first-side force-control-loop gain at least partially determines the response rate.

2. The method according to claim 1 further comprising steps of:

a) applying a second-side force to the spool with a second-side primary engaging element, b) determining a position of the first-side primary engaging element, c) determining a position of the second-side primary engaging element, and d) adjusting the position of the second-side primary engaging element according to the position of the first-side primary engaging element.

3. The method according to claim 2 further comprising steps of:

a) determining a second-side primary engaging element position set point according to the position of the first-side primary engaging element, b) providing a second-side primary engaging element position set point offset value, c) adjusting the second-side primary engaging element position set point according to the second-side position set point offset value, d) adjusting the position of the second-side primary engaging element according to the adjusted second-side primary engaging element position set point.

4. The method according to claim 1 further comprising steps of:

a) providing a thread-up percentage change value, b) adjusting the first-side force set point according to the provided thread-up percentage change value, and c) adjusting the first-side primary engaging element position according to the adjusted first-side force set point.

5. The method according to claim 1 further comprising steps of:

a) applying a second-side force to the spool with a second-side primary engaging element, b) determining a position of the second-side primary engaging element, d) determining a second-side force set point according to the desired nip load, e) determining a second-side force analog value, f) determining a second-side force error value according to the second-side force analog value and the second-side force set point, and g) adjusting the second-side primary engaging element position according to the second-side force error value.

6. The method according to claim 5 further comprising the steps of:

a) determining a second-side force-control-loop gain according to the radius of the wound roll, and b) adjusting the position of the second-side primary engaging element according to the second-side force control loop at a second-side response rate, wherein the second-side force-control-loop gain at least partially determines the second-side response rate.

7. The method according to claim 1 further comprising steps of:

a) applying a second-side force to the spool with a second-side primary engaging element, b) determining a second-side force set point according to the desired nip load, b) determining a second-side force analog value, c) determining a second-side force error value according to the second-side force analog value and the second-side force set point, and d) adjusting the second-side force according to the second side force error value.

8. The method according to claim 7 further comprising steps of:

a) determining a second-side force-control-loop gain according to the radius of the wound roll, and b) adjusting the second-side force to reduce the error value of the second-side force according to the second-side force control loop at a second-side response rate, wherein the second-side force-control-loop gain at least partially determines the second-side response rate.

9. The method according to claim 1 further comprising steps of:

a) determining a position of the first-side primary engaging element, b) providing a spool diameter, and c) adjusting the position of the first-side primary engaging element according to the spool diameter.

10. The method according to claim 1 wherein the step of determining a first-side force-control-loop gain according to the radius of the wound roll further comprises steps of:

a) determining a first-side force-control-loop proportional gain according to the radius of the wound roll, and b) determining a first-side force-control-loop integral gain according to the radius of the wound roll.

11. The method according to claim 1 further comprising steps of:

a) supporting the spool with the first-side primary engaging element at a first spool support angle, b) traversing the spool to a second spool support angle, c) determining a value analogous to the spool support angle, and d) adjusting the first-side force set point according to the value analogous to the spool support angle.

12. The method according to claim 1 wherein the first-side force-control-loop gain is determined according to a predetermined gain schedule.

13. A method of controlling the winding of a web material about a spool, the method comprising steps of:

a) providing a web material, b) providing a spool about which the web material may be wound, c) providing a desired nip load, d) determining a first-side force set point according to at least the desired nip load, e) applying a force to the spool with a first-side primary engaging element, f) supporting the web material with a rotating reel, g) forming a nip between the spool and the reel, h) passing the web material through the nip, i) winding the web material around the spool to form a wound roll, j) determining a first-side force analog value, k) determining a first-side force error value according to the first-side force analog value and the first-side force set point, l) determining a radius of the wound roll, m) determining a first-side force-control-loop gain according to the radius of the wound roll, n) adjusting the first-side primary engaging element force to reduce the first-side force error value according to the first-side force control loop at a response rate, wherein the first-side force-control-loop gain at least partially determines the response rate, o) applying a second-side force to the spool with a second-side primary engaging element, p) determining a position of the first-side primary engaging element, q) determining a position of the second-side primary engaging element, r) adjusting the position of the second-side primary engaging element according to the position of the first-side primary engaging element, s) supporting the spool with the first-side primary engaging element at a first spool support angle, t) traversing the spool to a second spool support angle, u) determining a value analogous to the spool support angle, and v) adjusting the first-side force set point according to the value analogous to the spool support angle.

14. The method according to claim 13 further comprising steps of:

a) determining a second-side force-control-loop gain according to the radius of the wound roll, and b) adjusting the position of the second-side primary engaging element according to the second-side force control loop at a second-side response rate, wherein the second-side force-control-loop gain at least partially determines the second-side response rate.

15. The method according to claim 13 further comprising steps of:

a) providing a thread-up percentage change value, b) adjusting the first-side force set point according to the provided thread-up percentage change value, and c) adjusting the first-side primary engaging element position according to the adjusted first-side force set point.

16. The method according to claim 13 further comprising steps of:

a) determining a position of the first-side primary engaging element, b) providing a spool diameter, and c) adjusting the position of the first-side primary engaging element according to the spool diameter.

17. The method according to claim 13 wherein the step of determining a first-side force-control-loop gain according to the radius of the wound roll further comprises steps of:

a) determining a first-side force-control-loop proportional gain according to the radius of the wound roll, and b) determining a first-side force-control-loop integral gain according to the radius of the wound roll.

18. The method according to claim 13 wherein the first-side force-control-loop gain is determined according to a predetermined gain schedule.

19. The method according to claim 13 further comprising steps of:

a) determining a second-side primary engaging element position set point according to the position of the first-side primary engaging element, b) providing a second-side primary engaging clement position set point offset value, c) adjusting the second-side primary engaging element position set point according to the second-side position set point offset value, d) adjusting the position of the second-side primary engaging element according to the adjusted second-side primary engaging element position set point.

* * * * *